US005535607A

United States Patent [19]

Dzurko et al.

[11] Patent Number: 5,535,607

[45] Date of Patent: Jul. 16, 1996

[54] DOOR LATCH WITH INTEGRAL SWITCH

[75] Inventors: Thomas A. Dzurko, Macomb; Frank J. Arabia, Jr., Shelby Township, both of Mich.; Pat Santarelli, Pickerington, Ohio

[73] Assignee: General Motors Corporation, Detroit, Mich.

[21] Appl. No.: 255,777

[22] Filed: Jun. 8, 1994

[51] Int. Cl.[6] ..... E05B 65/12

[52] U.S. Cl. ..... 70/237; 70/255; 70/264; 70/277; 70/DIG. 30; 200/61.62

[58] Field of Search ..... 70/264, DIG. 30, 70/257, 255, 237, 277, 238, 239, 258; 292/201, DIG. 3; 200/61.64, 61.72, 61.71, 61.62, 61.89; 180/287

[56] References Cited

U.S. PATENT DOCUMENTS

| | | | |
|---|---|---|---|
| 2,366,391 | 1/1945 | Dodge, Jr. | 180/287 X |
| 3,135,545 | 6/1964 | Abrams | 49/35 |
| 3,747,379 | 7/1973 | Cabanes | 70/280 X |
| 3,985,009 | 10/1976 | Lipschultz | 70/252 |
| 4,588,217 | 5/1986 | Escaravage | 292/201 |
| 4,664,430 | 5/1987 | Bernard | 292/201 |
| 4,806,712 | 2/1989 | Hoffman et al. | 200/61.62 |
| 4,978,153 | 12/1990 | Hirsch et al. | 292/201 |
| 5,240,296 | 8/1993 | Kobayashi | 292/201 |
| 5,277,461 | 1/1994 | Dzurko et al. | 292/216 |
| 5,381,065 | 1/1995 | Jones | 180/287 X |
| 5,454,608 | 10/1995 | Dzurko et al. | 292/216 |

FOREIGN PATENT DOCUMENTS 2254880 10/1992 United Kingdom .

*Primary Examiner*—Lloyd A. Gall
*Attorney, Agent, or Firm*—Jeffrey A. Sedlar

[57] ABSTRACT

A vehicle door latch includes an integral switch assembly which optionally includes a central locking switch and a central glass drive switch. The switches are responsive to movement of latch elements and perform the switching functions for circuitry that effects securement and unsecurement of the vehicle in a preselected manner.

4 Claims, 6 Drawing Sheets

DOOR LATCH WITH INTEGRAL SWITCH

BACKGROUND OF THE INVENTION

This invention relates to vehicle door latches.

Each door of a vehicle typically includes a latch mechanism that automatically latches the door when it is closed. The latch mechanisms include inside and outside mechanical unlatching handles that are attached to the latch by mechanical links and are used to open the doors. A latch also typically includes a lock mechanism to selectively prevent the unlatching of the vehicle door by use of the inside and outside handles. The lock mechanism is generally operable by means of a mechanical link connected to a lock button actuator inside the vehicle door and a key cylinder actuator outside the vehicle door. A power lock device may be added to the latch for electrical actuation of the lock mechanism. The conventional power lock device is operable electrically in response to at least one switch and is linked mechanically to the lock mechanism.

Vehicle doors also include a window regulator mechanism. The window regulator mechanism is used to drive the door window glass between opened and closed positions. Conventional window regulator mechanisms are manually driven or power driven by use of an electrical motor.

Vehicle doors and windows serve as access points to the vehicle's interior. Therefore, a means of conveniently securing vehicle doors and windows is required to inhibit unwanted access.

SUMMARY OF THE INVENTION

This invention includes a switch assembly that is associated with a conventionally operable door latch to provide switching functions in the electrical control of vehicle door mechanisms. The switching functions are controlled by the mechanical movement of conventional door latch components. The switch assembly includes at least one positionable switch arm that is integrated into the structure of the door latch. Repositioning of the switch arm is controlled by mechanical door latch mechanism elements. Positioning of the switch arm provides a switching function by opening and closing circuits through the selective registry of an electrically conductive element carried by the arm with mating control circuit contacts.

The switch assembly is adapted to optional use in providing the central locking function of vehicle doors, which provides the ability to automatically lock or unlock all vehicle doors through operation of one door's exterior door lock key cylinder actuator. Additionally, the switch assembly is adapted to optional use in providing the function of automatically opening and closing the windows of all or a preselected number of vehicle doors through operation of one door's exterior door lock key cylinder actuator. This invention provides a convenient means of securing and unsecuring all or any selected number or combination of vehicle doors and windows.

DETAILED DESCRIPTION OF THE PRESENTLY PREFERRED EMBODIMENT

Figure 1:
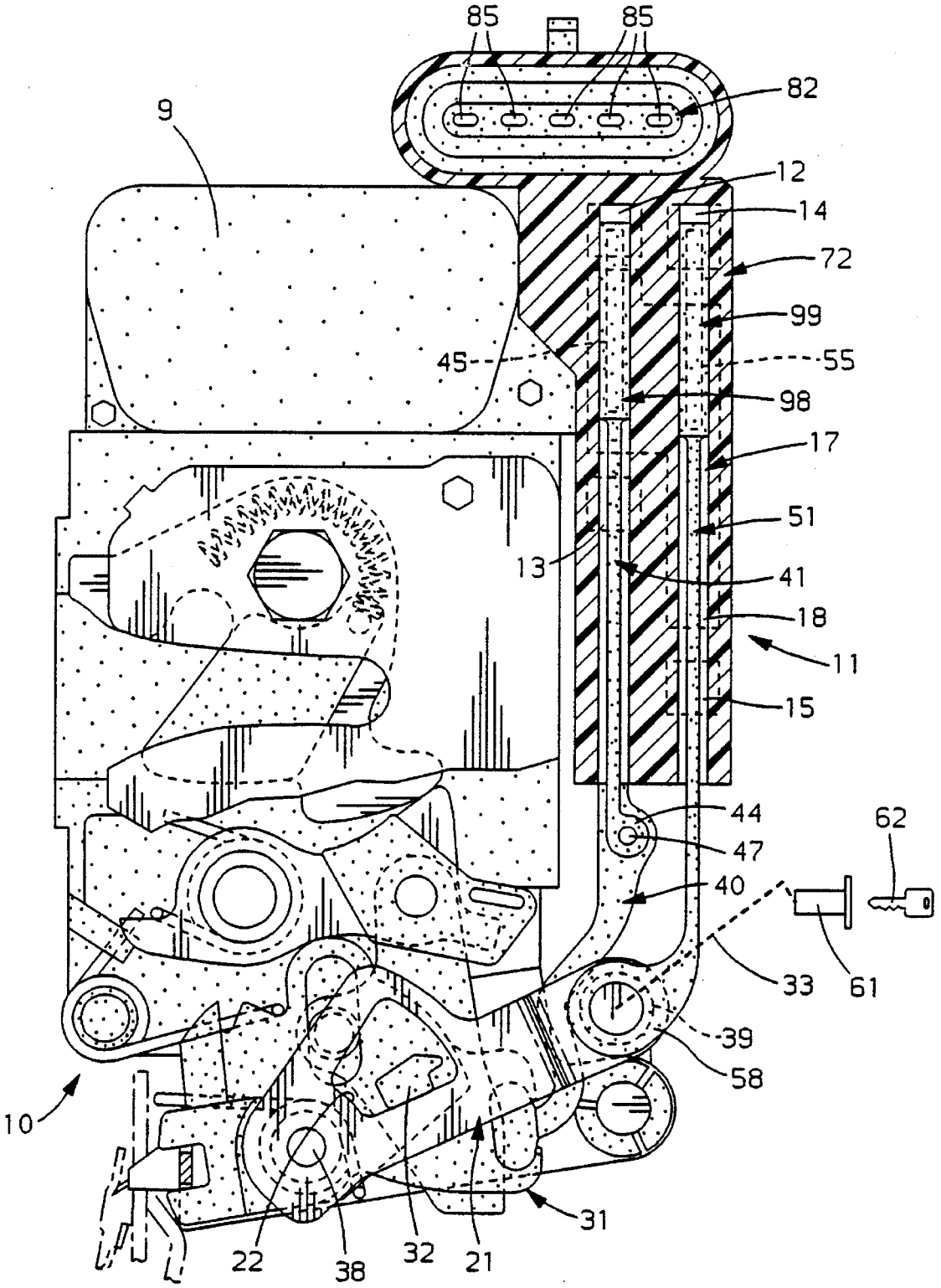
FIG. 1 is a partial sectional view of a latch and switch assembly.

Referring to the drawings, FIG. 1 illustrates a latch assembly 10 and a switch assembly 11 integrated therewith in a unitary design. A detailed explanation of the mechanical latch and lock components of the latch assembly can be found in U.S. Pat. No. 5,277,461 to Dzurko, et al, which issued Jan. 11, 1994 and is commonly assigned.

The latch assembly 10 includes outside lock operating lever 21 which is pivotally mounted on stud 38. Outside lock operating lever 21 is connected to key cylinder assembly 61 (shown schematically) through the mechanical link comprised of outside lock rod 33. Upon positioning a unique key 62 in key cylinder assembly 61 and rotating key 62, the outside lock operating lever 21 is responsively rotated about stud 38 either clockwise or counterclockwise by outside lock rod 33.

Pivotally mounted on stud 38 and engaging outside lock operating lever 21 is locking lever 31. Locking lever 31 effects the locking function of latch 10. Locking lever 31 includes integral projection 32 which engages outside lock operating lever 21 in sector-shaped cutout 22. Therefore, outside lock operating lever 21 and locking lever 31 are linked mechanically to one another to rotate in unison, with lost motion therebetween, provided by the sector-shaped cutout 22 and integral projection 32. This permits a preselected amount of rotation of lock operating lever 21 to occur before locking lever 31 is engaged. The lost motion between outside lock operating lever 21 and locking lever 31 permits the rotation of key cylinder 61 back to vertical to remove key 62 therefrom, after the key cylinder 61 has been used to effect repositioning of locking lever 31, without moving the locking lever 31 from its repositioned location.

Figure 2:
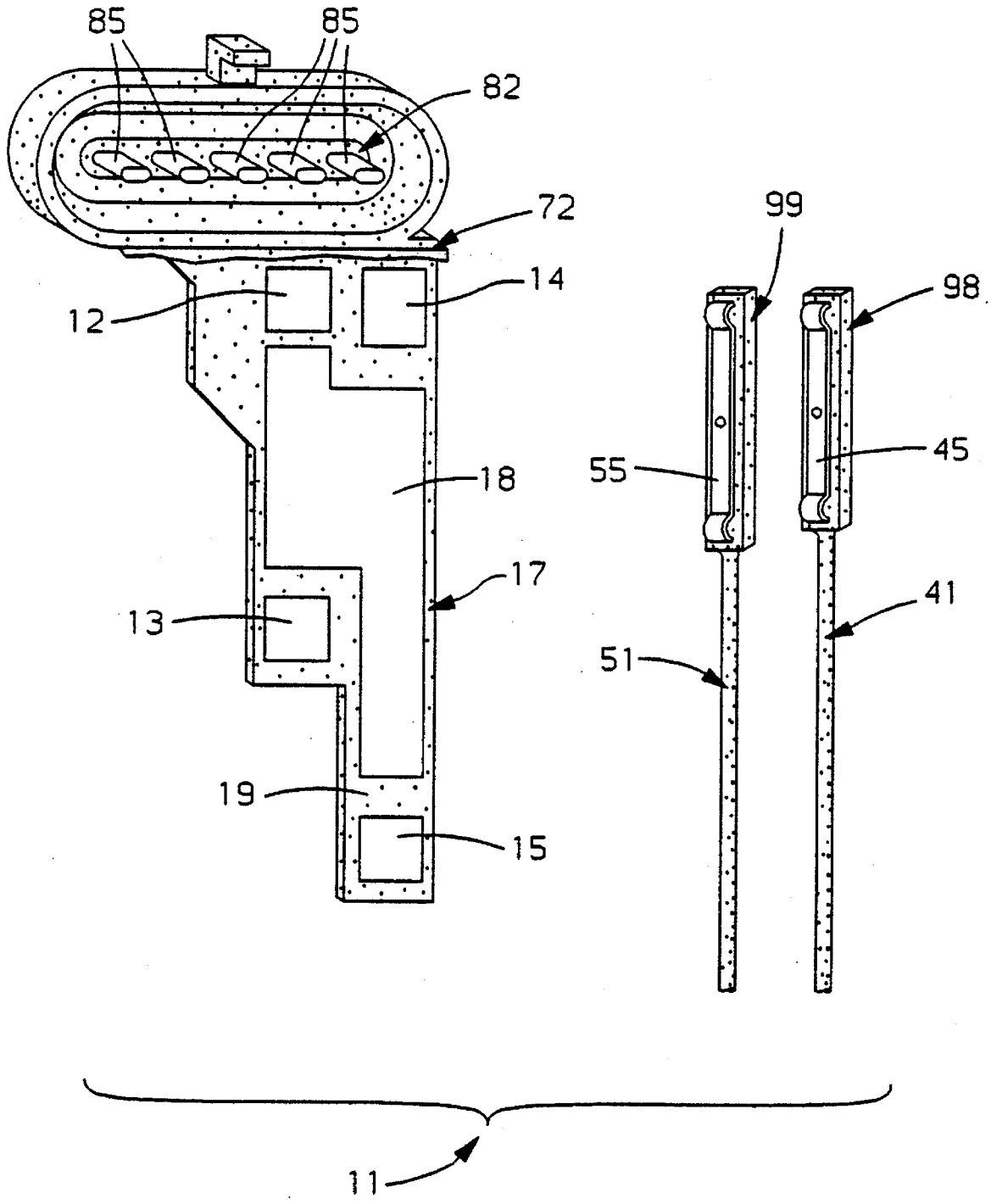
FIG. 2 is a detailed view of a switch assembly with the actuator arms shown exploded and rotated.

Integrated into the latch assembly 10 is switch housing 72. Switch housing 72 houses switch assembly 11. Referring to FIG. 2, switch assembly 11 includes: 1) printed circuit 17 which includes insulator board 19 and switch operating pads 12, 13, 14, 15 and 18; 2) five pin connector 82 including five terminal members represented by terminal member 85; 3) glass drive switch actuator arm 51, which includes conductor element 55; and 4) central door lock actuator arm 41, which includes conductor element 45. Each of the switch operating pads 12, 13, 14, 15 and 18 are connected to one of the five terminal members 85 of the pin connector 82. Each terminal member 85 is in turn connected to control circuitry (not illustrated) for the operation of vehicle systems in response to operation of switch assembly 11, according to predetermined control logic. Switch operating pad 18 is connected through pin connector 82 to vehicle ground reference.

Door lock actuator arm 41 includes connector 44, which snap fittingly engages receptacle 47 on power door latch lock actuator arm 40. Door latch lock actuator arm 40 engages locking lever 31 and moves rectilinearly in relation to switch housing 72 in coordination with rotation of locking lever 31. Door lock actuator arm 41 moves in coordination with power door latch lock actuator arm 40 and therefore, with locking lever 31.

Figure 3:
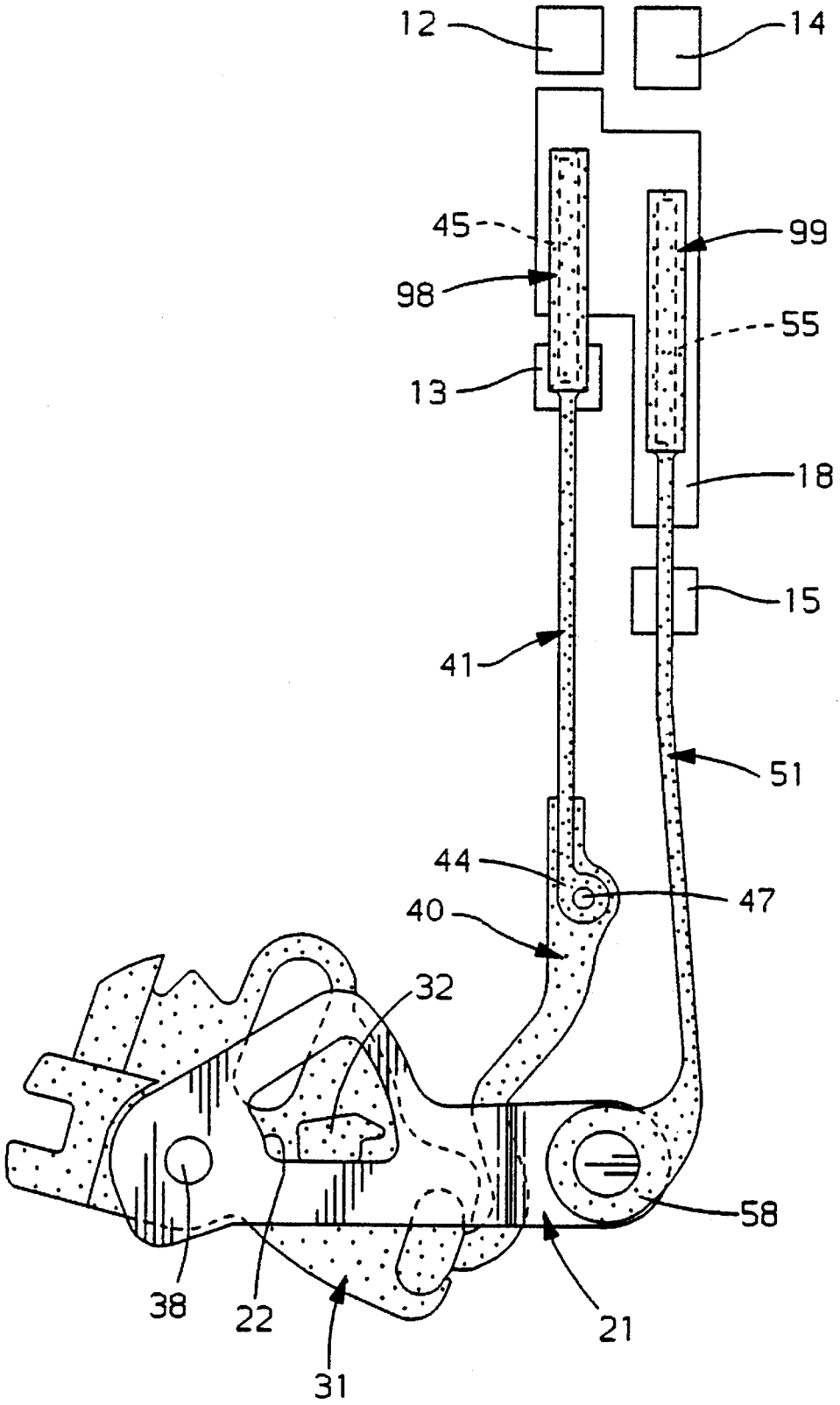
FIG. 3 is a detailed view of a switch mechanism.
Figure 5:
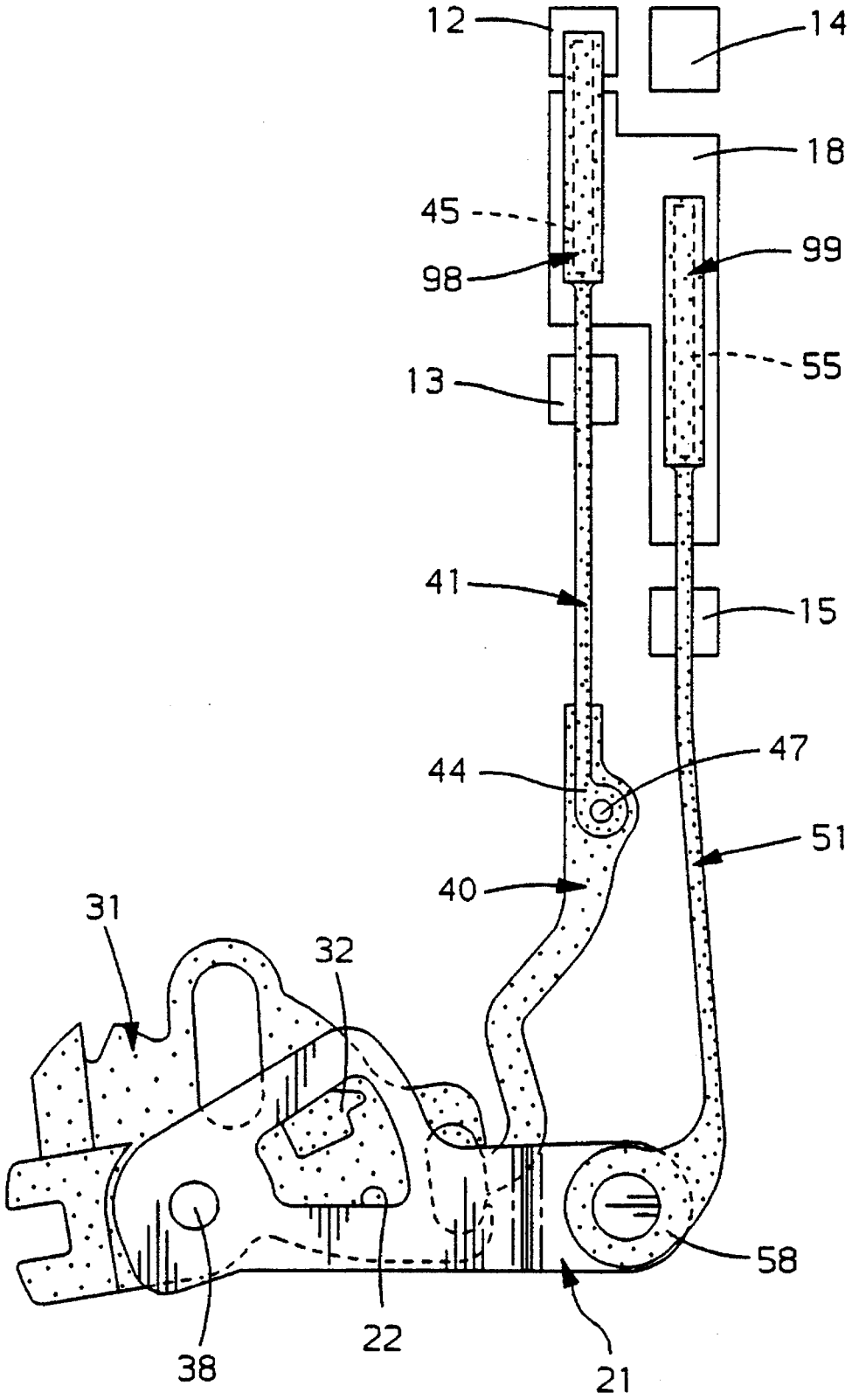
FIG. 5 is a detailed view of a switch mechanism.

Locking lever 31 is rotatably positionable about stud 38 between the locked position shown in FIG. 3 and the unlocked position shown in FIG. 5.

A reversible electric motor assembly 9, shown in FIG. 1, provides the motive power for mechanically moving power door latch lock actuator arm 40 to selectively reposition locking lever 31 between the locked and unlocked positions. Additionally, lock operating lever 21 is repositioned through use of key cylinder 61 and key 62, shown in FIG. 1, to rotate locking lever 31 between the locked and unlocked positions. When locking lever 31 moves between the locked and unlocked positions, power door latch lock actuator arm 40 moves between positions corresponding to the locked and unlocked condition. Accordingly, the engaged door lock actuator arm 41 also moves between positions corresponding to a locked and unlocked condition of latch 10.

Figure 4:
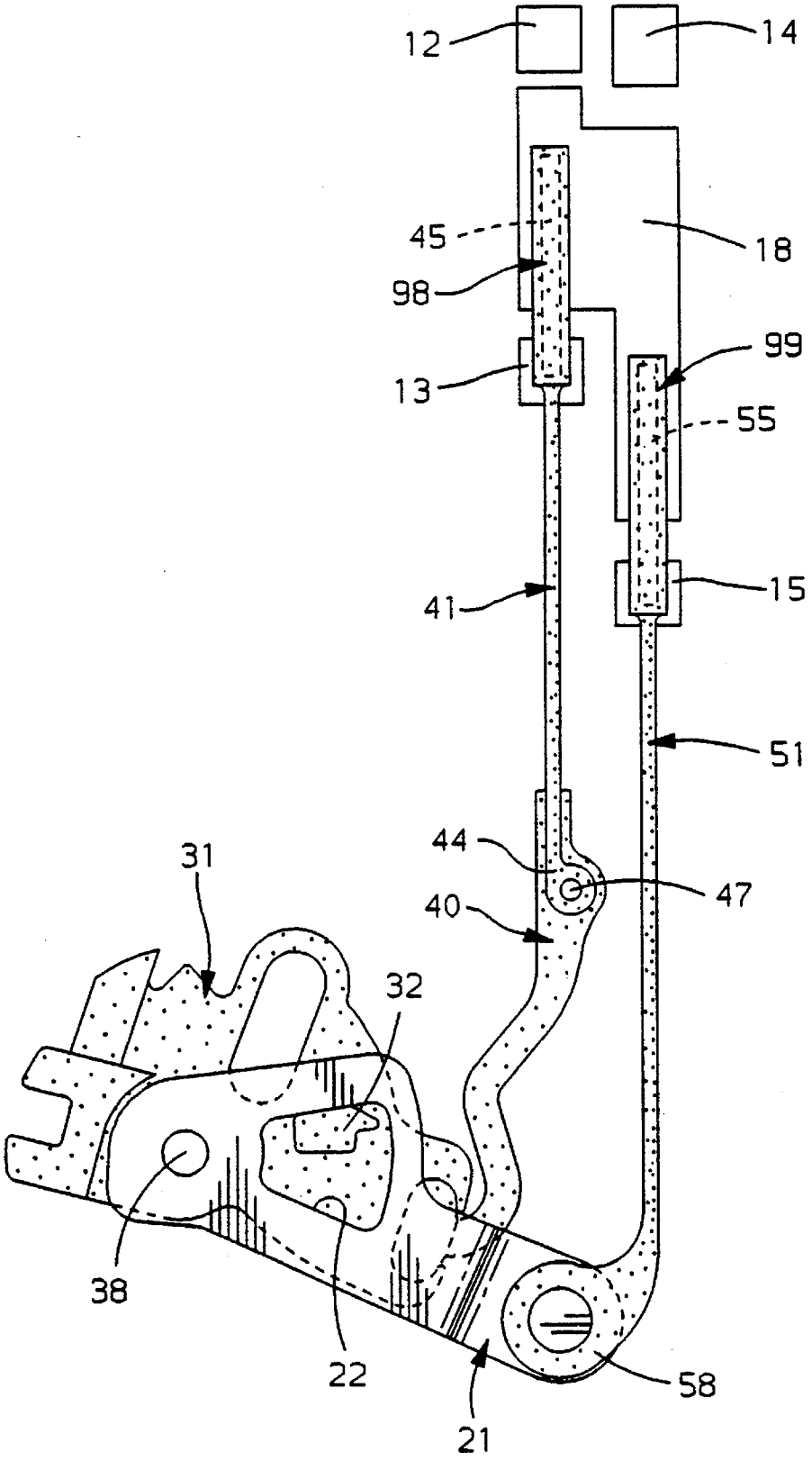
FIG. 4 is a detailed view of a switch mechanism.
Figure 6:
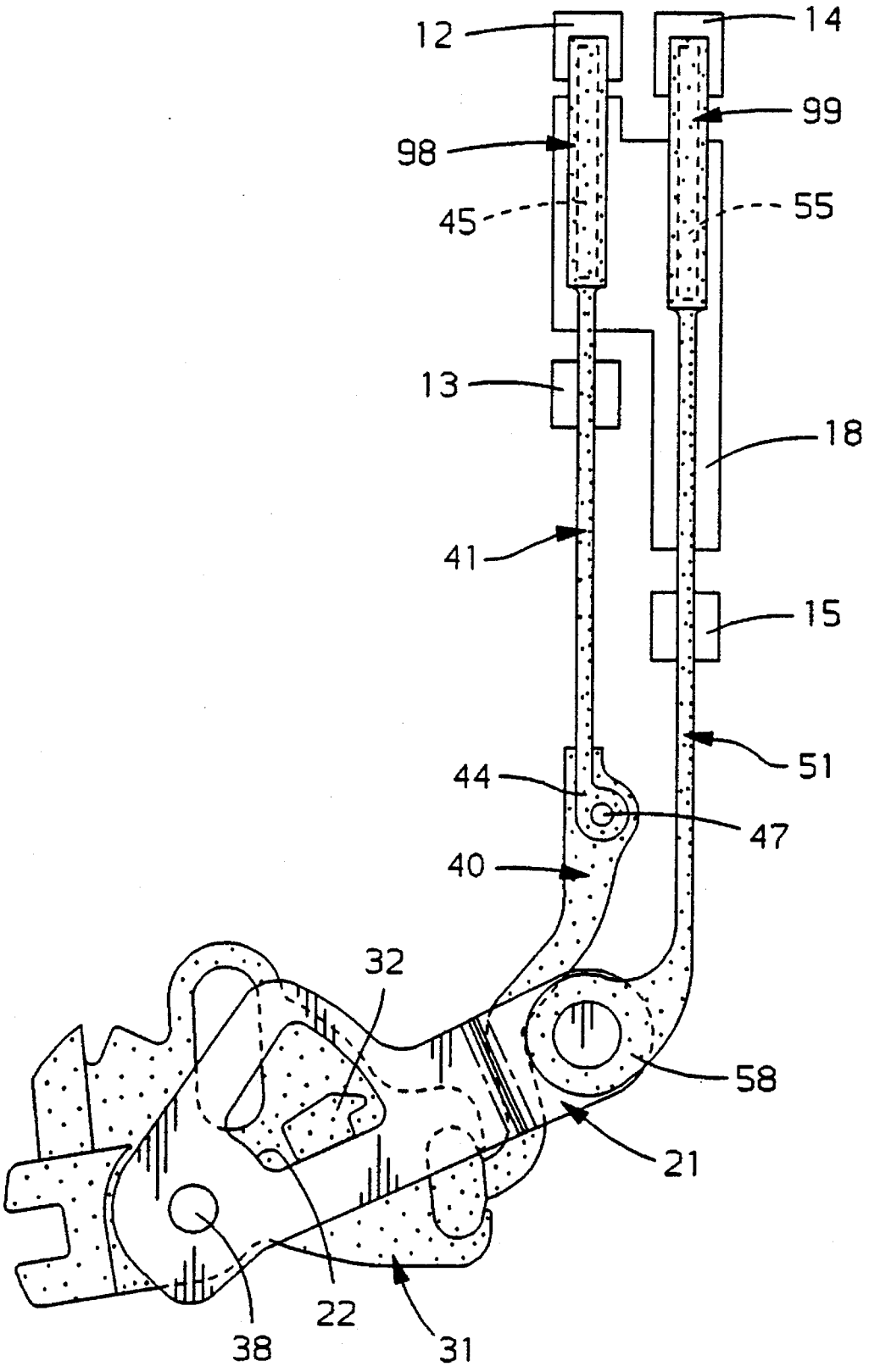
FIG. 6 is a detailed view of a switch mechanism.

The switch 98 associated with door lock actuator arm 41 is of the conventional sliding contact type. Switch 98 comprises a two-position switch wherein conductor element 45 completes registry between switch operating pads 13 and 18 when locking lever 31 is in the locked position or between switch operating pads 12 and 18 when locking lever 31 is in the unlocked position. Therefore, switch 98 completes a circuit between switch operating pads 12 and 18 when latch 10 is unlocked, as illustrated in FIGS. 5 and 6, and between switch operating pads 13 and 18 when latch 10 is locked as illustrated in FIGS. 3 and 4.

The switching function provided by switch 98 and door lock actuator arm 41 provides a central locking function. Through the connection between switch 98 and the vehicle control circuitry via pin connector 82, the repositioning of door lock actuator arm 41 signals a conventional controller (not illustrated) to, in response, lock or unlock all of the vehicle's doors. Accordingly, when key 62 is used to rotate key cylinder 61 and therefore, to move locking lever 31 between the locked and unlocked positions, control logic is provided to initiate like repositioning of all or a selected number of the other vehicle door latch locking levers through their associated power actuator systems.

Also included in switch assembly 11 is switch 99 which includes glass drive switch actuator arm 51. Provided is a three-position switch, movable between a drive up position as illustrated in FIG. 4, a neutral position as illustrated in FIGS. 3 and 5 and a drive down position as illustrated in FIG. 6.

Glass drive switch actuator arm 51 includes integral clip 58 which snap fittingly engages rod opening 39 of lock operating lever 21. Accordingly, glass drive switch actuator arm 51 moves rectilinearly in switch housing 72 in coordination with rotational movement of lock operating lever 21. Outside lock rod 33 engages lock operating lever 21 through integral clip 58 in opening 39.

Glass drive switch actuator arm 51 includes conductor element 55 which completes registry between switch operating pads 14 and 18 as illustrated in FIG. 6 or between switch operating pads 15 and 18 as illustrated in FIG. 4. Glass drive switch actuator arm 51 is movable between the neutral position of FIGS. 3 and 5, the drive up position of FIG. 4 where registry is established between switch operating pads 15 and 18, and the drive down position of FIG. 6 where registry is established between switch operating pads 14 and 18.

Switch 99 comprises a switch of the conventional sliding contact type. Lock operating lever 21 and the connected glass drive switch actuator arm 51 are moved between the neutral, drive up and drive down positions by outside lock rod 33 through rotation of key 62 in key cylinder 61.

Lock operating lever 21 is rotatable by turning key 62 in key cylinder 61 to reposition locking lever 31 between the locked and unlocked positions. Locking lever 31 places latch 10 in either a locked or an unlocked condition. When lock operating lever 21 repositions locking lever 31 to the locked position as shown in Figure,4, conductor element 55 of glass drive switch actuator arm 51 completes registry between switch operating pads 15 and 18. When lock operating lever 21 repositions locking lever 31 to the unlocked position as shown in FIG. 6, conductor element 55 of glass drive actuator arm 51 completes registry between switch operating pads 14 and 18.

Once locking lever 31 has been positioned in the locked or unlocked position, key 62 is rotatable back to the vertical position in key cylinder 61 thereby moving lock operating lever 21 and glass drive switch actuator arm 51 to the neutral position as shown in FIG. 5 wherein conductor element 55 is in the neutral position and is not completing any switching registry. With lock operating lever 21 in the neutral position of FIGS. 3 and 5, locking lever 31 is movable by means of power door latch lock actuator arm 40 between the locked position of FIG. 3 and the unlocked position of FIG. 5 without moving switch 99 from a neutral condition.

Key 62 is used to lock and unlock latch 10 and optionally, to simultaneously open or close selected vehicle window glass (not shown) as predetermined in the control logic of the system by completing registry between predetermined switch operating pads. Window glass movement is provided when the switch 99 is engaged to complete registry between predetermined switch operating pads but not when in the neutral position. This supplies the operator with control over the travel of the glass. When key 62 is rotated to the vertical position and removed from key cylinder 61, conductor element 55 of glass drive switch actuator arm 51 is parked in the neutral position wherein a glass drive circuit is not completed.

The switching functions operate as follows. To lock and secure a vehicle, key 62 is positioned in key cylinder 61 and rotated to a locked position. In turn, lock rod 33 rotates lock operating lever 21 clockwise wherein sector opening 22 contacts projecting wedge 32 of locking lever 31 whereby lock operating lever 21 and locking lever 31 are positioned in the locked position of FIG. 4. In turn, glass drive switch actuator arm 51 is positioned in the drive up position of FIG. 4. In this position, conductor element 45 completes registry between switch operating pads 13 and 18, thereby completing a circuit wherein all of the other vehicle doors are, in response, power driven to their locked positions.

When key 62 is in the locked position, conductor element 55 of glass drive switch actuator arm 51 completes registry between switch operating pads 15 and 18. When key 62 is held in the locked position for a predetermined period of time, the controller initiates the drive motors (not illustrated) of other preselected vehicle windows to drive them to their closed positions. Thereby, o through rotation of key 62 to a locked position all of the vehicle's latches are locked and all of the vehicle's windows are closed, thus securing the vehicle.

After securement, key 62 is rotated back to the vertical position and removed from key cylinder 61. This rotates lock operating lever 21 counterclockwise to the neutral position, as shown in FIG. 3, placing glass drive switch actuator arm 51 in the neutral position. Rotation of lock operating lever 21 from the drive up position to the neutral position does not effect repositioning of locking lever 31 which remains in the locked position as shown in FIG. 3.

To unsecure the vehicle, key 62 is positioned in key cylinder 61 and rotated to the unlocked position. This causes lock rod 33 to rotate lock operating lever 21 in a counterclockwise direction. Sector opening 22 contacts projecting wedge 32, wherein lock operating lever 21 and locking lever 31 are rotated to the unlocked position as shown in FIG. 6. In turn, glass drive switch actuator arm 51 is positioned in the drive down position of FIG. 6. With locking lever 31 in the unlocked position, conductor element 45 of door lock actuator arm 41, completes registry between switch operating pads 12 and 18. This completes an unlock circuit, wherein the controller initiates the power unlocking of all or a selected number of the other vehicle latches through their associated electric motor actuator.

When key 62 is in the unlocked position, conductor element 55 of glass drive switch actuator arm 51 completes registry between switch operating pads 14 and 18. When key 62 is held in the unlocked position for a predetermined period of time, the controller initiates the drive motors of other preselected vehicle windows to drive them to their open positions. Thereby, through rotation of key 62 to the unlock position, all or a selected number of the vehicle's latches are unlocked and preselected windows are opened.

When key 62 is positioned in key cylinder 61 it is rotatable between the locked and unlocked positions and thereby the operator maintains control over driving of the vehicle windows either upward or downward and the drive direction can be reversed through rotation of key 62 and a preferred amount of opening is established. The invention thereby provides a switch assembly 11 integral with the latch assembly 10 to provide a central vehicle locking function and a central vehicle window drive function in a predetermined manner to conveniently secure and unsecure the vehicle.

This system is operable to effect the latch locking and the glass drive functions of any selected number or combination of vehicle doors. The system is also operable to provide either the latch locking function or the glass drive function independently. System operation is effected from either the driver or passenger side vehicle doors.

What is claimed is:

1. A door latch comprising:

a rotatable lock operating lever;

a switch housing spaced away from the lock operating lever;

a positionable elongated switch arm connected to the lock operating lever, extending into the switch housing and incorporating a conductor element; and a plurality of switch operating pads registerable by the conductor element to initiate closing and opening of a window wherein the switch arm is movable rectilinearly within the switch housing in response to rotation of the lock operating lever.

2. A door latch comprising:

a rotatable locking lever;

a rotatable lock operating lever engaging the locking lever;

a switch housing spaced away from the locking lever and the lock operating lever;

an actuator arm connected to the locking lever;

a first switch arm connected to the actuator arm and extending into the switch housing wherein the first switch arm is movable rectilinearly within the switch housing in response to rotation of the locking lever;

a second switch arm connected to the lock operating lever and extending into the switch housing wherein the second switch arm is movable rectilinearly within the switch housing in response to rotation of the lock operating lever;

a first switch, opening and closing in response to movement of the first switch arm; and a second switch opening and closing in response to movement of the second switch arm.

3. A door latch and key cylinder for use in a vehicle door comprising:

a locking lever;

an actuator arm connected to the locking lever;

a first switch arm connected to the actuator arm moveable in a generally linear direction and registerable with one of two operable lock switch pads;

a lock operating lever engaging the locking lever and mechanically linked to the key cylinder; and a second switch arm connected to the lock operating lever moveable in a generally linear direction and registerable with one of two operable glass drive switch pads.

4. A door latch and rotatable key cylinder for use in a door comprising:

a lock operating lever mechanically linked to the key cylinder and rotatable in response to rotation of the key cylinder;

a locking lever engaging the lock operating lever with lost motion occurring therebetween and rotatable in response to rotation of the lock operating lever;

a power actuator arm connected to the locking lever and being generally linearly positionable to selectively rotate the locking lever;

an elongated first switch arm having a first end that is snap fittingly engaged to the actuator arm and a second end that carries a conductor element that is registerable with a switch operating pad connected to vehicle ground and one of two alternative lock switch operating pads connected to control circuitry;

an elongated second switch arm having a first end that is snap fittingly engaged to the lock operating lever and a second end that carries a conductor element that is registerable with the switch operating pad connected to vehicle ground and one of two alternative glass drive switch operating pads connected to the control circuitry.

* * * * *